US012226818B2

(12) United States Patent
Zhang et al.

(10) Patent No.: US 12,226,818 B2
(45) Date of Patent: Feb. 18, 2025

(54) LOW-PRESSURE ALUMINUM CASTING MOLD AND LOW-PRESSURE ALUMINUM CASTING PROCESS FOR MOTOR ROTOR

(71) Applicant: SHANXI ELECTRIC MOTOR MANUFACTURING CO., LTD., Taiyuan (CN)

(72) Inventors: Wenhe Zhang, Taiyuan (CN); Zeyong Wu, Taiyuan (CN); Xijuan Zhai, Taiyuan (CN); Xiangyong Kong, Taiyuan (CN); Hongrong Zhang, Taiyuan (CN); Chao Cui, Taiyuan (CN); Junwei Yan, Taiyuan (CN); Biao Hu, Taiyuan (CN)

(73) Assignee: SHANXI ELECTRIC MOTOR MANUFACTURING CO., LTD., Taiyuan (CN)

( * ) Notice: Subject to any disclaimer, the term of this patent is extended or adjusted under 35 U.S.C. 154(b) by 0 days.

(21) Appl. No.: 18/561,188

(22) PCT Filed: Jul. 5, 2022

(86) PCT No.: PCT/CN2022/103843
§ 371 (c)(1),
(2) Date: Nov. 15, 2023

(87) PCT Pub. No.: WO2023/284587
PCT Pub. Date: Jan. 19, 2023

(65) Prior Publication Data

US 2024/0253110 A1 Aug. 1, 2024

(30) Foreign Application Priority Data

Jul. 15, 2021 (CN) ..... 202110802448.5
Jul. 15, 2021 (CN) ..... 202121610699.5

(51) Int. Cl.
*B22D 18/04* (2006.01)
*B22D 19/00* (2006.01)
*B22D 33/04* (2006.01)

(52) U.S. Cl.
CPC ..... *B22D 18/04* (2013.01); *B22D 19/0054* (2013.01); *B22D 33/04* (2013.01)

(58) Field of Classification Search
CPC .... B22D 18/04; B22D 19/00; B22D 19/0054; B22D 33/04
(Continued)

(56) References Cited

U.S. PATENT DOCUMENTS 3,349,478 A * 10/1967 De Jean ..... H02K 1/28 310/43
2003/0062786 A1* 4/2003 Reiter, Jr. et al. ... H02K 17/168 310/156.08
(Continued)

FOREIGN PATENT DOCUMENTS

CN 204545381 U 8/2015
CN 109274226 A 1/2019
(Continued)

OTHER PUBLICATIONS

International Search Report and Written Opinion for PCT/CN2022/103843, filed Jul. 5, 2022.
(Continued)

*Primary Examiner* — Kevin P Kerns
(74) *Attorney, Agent, or Firm* — Paul D. Bianco; Fleit Intellectual Property Law

(57) ABSTRACT

A low-pressure aluminum casting mold and a low-pressure aluminum casting process for a motor rotor. The low-pressure aluminum casting mold includes an upper blade profile assembly, a lower blade profile assembly, a rotor core, a dummy shaft and a diverter. The upper blade profile assembly includes an upper backing plate and an upper mold, and the lower blade profile assembly includes a lower backing plate and a lower mold. The low-pressure aluminum casting mold further includes a first pressing device and four sets of second pressing devices. The low-pressure aluminum casting process includes the steps of cold lamination, heating of the rotor core, mold preparation, hot lamination, and low-pressure casting.

3 Claims, 3 Drawing Sheets

(58) Field of Classification Search
USPC ..... 164/271, 98, 108, 109, 112
See application file for complete search history.

(56) References Cited

U.S. PATENT DOCUMENTS

| | | | | |
|---|---|---|---|---|
| 2004/0231818 | A1* | 11/2004 | Edwards et al. ... | B22D 19/0054<br>164/109 |
| 2011/0283525 | A1* | 11/2011 | Czebiniak ..... | H02K 1/26<br>29/598 |
| 2015/0349616 | A1* | 12/2015 | Buttner et al. ..... | H02K 15/0012<br>29/598 |

FOREIGN PATENT DOCUMENTS

| | | | |
|---|---|---|---|
| CN | 109986056 | A | 7/2019 |
| CN | 111496225 | A | 8/2020 |
| CN | 212371156 | U | 1/2021 |
| CN | 113319265 | A | 8/2021 |

OTHER PUBLICATIONS

Xiangyong Kong. "Constructional Improvement of the Dummy Spindle used in the Rotor's Low-pressure Aluminum-casting", 2015, ISSN: 1006-280, Electrical Machinery Technology.
International Preliminary Report on Patentability dated Jan. 16, 2024 for PCT/CN2022/103843 filed Jul. 5, 2022.

* cited by examiner

LOW-PRESSURE ALUMINUM CASTING MOLD AND LOW-PRESSURE ALUMINUM CASTING PROCESS FOR MOTOR ROTOR

RELATED APPLICATIONS

The present application claims all the benefits of the Chinese patent application Nos. 202110802448.5 entitled "LOW-PRESSURE ALUMINUM CASTING PROCESS AND MOLD FOR CAST-ALUMINUM ROTOR WITH SPECIAL END PLATE STRUCTURE" and 202121610699.5 entitled "LOW-PRESSURE ALUMINUM CASTING MOLD FOR CAST-ALUMINUM ROTOR WITH SPECIAL END PLATE STRUCTURE", which were all filed on Jul. 15, 2021 before the National Intellectual Property Administration, PRC.

FIELD OF THE INVENTION

The present invention belongs to the technical field of low-pressure aluminum casting, and particularly relates to a low-pressure aluminum casting mold and low-pressure aluminum casting process for motor rotor.

BACKGROUND OF THE INVENTION

Low-pressure aluminum casting is such a casting method that makes molten aluminum fill and solidify in the mold cavity under the action of low-pressure so as to obtain high-quality castings. It has high production efficiency and thus is widely used.

However, in actual operations, the existing low-pressure aluminum casting mold and process cannot ensure the lamination compactness of rotor core, and there is a hidden danger of aluminum leakage in the aluminum casting process, which reduces the success rate of aluminum casting of motor rotor. Moreover, once aluminum leakage occurs, aluminum liquid will solidify on the end plate of the rotor motor, which will seriously affect the ventilation and heat dissipation of the motor.

In addition, in actual operations, it is difficult to determine the technological parameters of low-pressure aluminum casting, which easily leads to defects in the motor rotor and affects the electrical and mechanical properties of the motor rotor.

SUMMARY OF THE INVENTION

In view of the shortcomings of the prior art, the present invention provides a low-pressure aluminum casting mold and a low-pressure aluminum casting process for motor rotor, and solves the technical problems in the traditional low-pressure aluminum casting process and mold such as hidden dangers of aluminum leakage, poor ventilation and heat dissipation of the motor, reduction of the success rate of aluminum casting of the motor rotor.

In one aspect of the present invention, there is provided a low-pressure aluminum casting mold for motor rotor, which includes an upper blade profile assembly, a lower blade profile assembly, a rotor core, a dummy shaft and a diverter, wherein the upper blade profile assembly includes an upper backing plate and an upper mold, the lower blade profile assembly includes a lower backing plate and a lower mold; the dummy shaft includes a vertically arranged shaft body, a dummy shaft upper cover arranged at the upper part of the shaft body, and a dummy shaft lower cover arranged at the lower part of the shaft body; the diverter is arranged between the dummy shaft and the lower mold, wherein:

- the low-pressure aluminum casting mold further includes a first pressing device and four sets of second pressing devices, the first pressing device is arranged at the top of the dummy shaft to press the middle part of the rotor core, and the four sets of second pressing devices are arranged at four corner positions of the low-pressure aluminum casting mold;
- the middle parts of the four corners of the lower backing plate are respectively provided with horizontal clamping slots and U-shaped holes, the U-shaped hole is provided on the lower backing plate and above the clamping slot, the opening of the U-shaped hole faces the outside, and the position of the upper backing plate corresponding to the U-shaped hole is provided with a hold-down through hole;
- the second pressing device includes a pull rod, a clamping plate and a hold-down nut, the clamping plate is arranged in the clamping slot, the pull rod is vertically arranged with its bottom end passing through the U-shaped hole and connecting with the top surface of the clamping plate, the outer wall of the upper section of the pull rod is provided with external threads, the top end of the pull rod passes through the corresponding hold-down through hole, and the hold-down nut is connected with the external threads on the pull rod by threads.

Further, in the low-pressure aluminum casting mold for motor rotor, the area of the horizontal cross section of the clamping slot is larger than that of the U-shaped hole.

Further, in the low-pressure aluminum casting mold for motor rotor:

- the first pressing device includes a pressing cover and an eyebolt, the pressing cover is a cylindrical tube structure with an open bottom and is coaxially covered on the top of the dummy shaft, and the bottom edge of the pressing cover is pressed on the top surface of the rotor core;
- the middle part of the dummy shaft upper cover is provided with a first threaded hole, the top surface of the pressing cover is provided with a second threaded hole, and the lower end of the eyebolt passes through the second threaded hole and is connected with the first threaded hole.

Further, in the low-pressure aluminum casting mold for motor rotor:

- the middle part of the shaft body is vertically provided with a first through hole, the bottom end of the first through hole is coaxially provided with an annular clamping slot, and the inner diameter of the annular clamping slot is larger than that of the first through hole;
- the dummy shaft lower cover includes a circular cover plate and a cover body arranged on the top surface of the circular cover plate, the cover body has a vertically arranged cylindrical structure, the upper part of the cover body extends into the first through hole and the bottom surface of the shaft body is arranged on the top surface of the circular cover plate, the outer wall of the lower part of the cover body is provided with an annular clamping table matched with the annular clamping slot, the outer diameter of the circular cover plate is larger than that of the shaft body, and the middle part of the dummy shaft lower cover is vertically provided with a second through hole;

the diverter has a cylindrical structure, the middle of the top surface of the diverter is provided with a cover plate placing groove matched with the circular cover plate, the center of the cover plate placing groove is coaxially provided with a cylindrical protrusion which extends into the second through hole, the circular cover plate is placed in the cover plate placing groove, and the center of the bottom surface of the diverter is provided with an arc protrusion which bulges downward.

Further, in the low-pressure aluminum casting mold for motor rotor, there is clearance fit between the cylindrical protrusion and the second through hole, and there is clearance fit between the cover plate placing groove and the circular cover plate.

Further, in the low-pressure aluminum casting mold for motor rotor, chamfers are arranged at the outer edge of the bottom surface of the circular cover plate, the outer edge of the bottom surface of the diverter, the bottom edge of the cover plate placing groove and the bottom edge of the second through hole.

In another aspect of the present invention, there is provided a low-pressure aluminum casting process for motor rotor, which includes the following steps:

1) cold lamination: sequentially stacking a plurality of rotor laminations on the dummy shaft of the low-pressure aluminum casting mold, applying a lamination pressure to the pressing cover of the first pressing device by an oil press, thereby laminating the plurality of rotor laminations to form a rotor core, wherein the tonnage of the oil press is 30-50 T and the lamination pressure exerted by the oil press is 2.5-3.0 MPa; after the whole height of the rotor core reaches a first specified length, the rotor core is fastened to the dummy shaft by the pressing cover and eyebolt of the first pressing device;
2) heating of the rotor core: transporting the rotor core fastened to the dummy shaft by the first pressing device in step 1) to a heating furnace for heating, wherein, firstly the rotor core is heated at a temperature rise rate of 70-90° C./h for 1 hour and then kept warm for 1 hour, then the rotor core is heated at a temperature rise rate of 70-90° C./h for 1 hour and then kept warm for 1 hour, finally the rotor core is heated at a temperature rise rate of 80-100° C./h for 1 hour and then kept warm for 5 hours;
3) mold preparation: assembling the lower backing plate and the lower mold, placing the diverter on the lower mold, installing the clamping plate in the clamping slot of the lower backing plate, and vertically setting the pull rod in place;
4) hot lamination: lifting the rotor core heated in step 2) out of the heating furnace, placing the lower cover of the dummy shaft on the diverter, placing the upper backing plate and the upper mold on the rotor core, passing the hold-down through hole on the upper backing plate through the upper end of the pull rod, preliminarily fastening the rotor core by a hold-down nut, and starting the oil press to continuously laminate the rotor core until the overall height of the rotor core reaches a second specified length, and then tightening the hold-down nut again;
5) low-pressure casting: quickly lifting the whole mold fastened in step 4) to a low-pressure aluminum casting machine for aluminum casting, and completing the low-pressure aluminum casting of the motor rotor.

Further, in the low-pressure aluminum casting process for motor rotor, the second specified length of the rotor core in hot lamination is 1.013 times of the first specified length of the rotor core in cold lamination.

Further, in the low-pressure aluminum casting process for motor rotor, in the low-pressure casting step, the pressure parameters of low-pressure aluminum casting are controlled as follows:

5.1) liquid lifting stage: pressurizing the molten aluminum at a pressure rise rate of 4.6-5.0 KPa/s for 10 s from an initial pressure of 2 KPa, thereby making the pressure reach 48-52 KPa;
5.2) mold filling stage: pressurizing at a pressure rise rate of 7.3-7.7 KPa/s for 4 s, thereby making the pressure reach 77.2-82.8 KPa;
5.3) pressure maintaining stage: maintaining the pressure at 77.2-82.8 KPa for 405 s;
5.4) pressure release stage: releasing the residual pressure after the pressure maintaining stage is completed.

The low-pressure aluminum casting mold for motor rotor has the following beneficial effects:

The compression of the first pressing device and the second pressing device ensures the lamination compactness of the rotor core, thoroughly eliminates the hidden danger of aluminum leakage in the aluminum casting process of the rotor, improves the success rate of aluminum casting of the motor rotor, ensures the quality of the cast-aluminum rotor, and has the advantages of simple process and low cost.

The second pressing device fastens the upper backing plate and the lower backing plate through the pull rod, which realizes the pressing of the upper and lower molds and the rotor core. It has simple structure and there is no need to add complicated pressing equipment for compression. The operation and adjustment are convenient and the operation efficiency is also improved.

The downward-bulged arc protrusion arranged at the center of the bottom surface of the diverter makes the distribution of molten aluminum more uniform and thus improves the casting quality.

The low-pressure aluminum casting process for motor rotor has the following beneficial effects:

Through the cold lamination and hot lamination together with the double compression of the first pressing device and the second pressing device, the lamination compactness of the rotor core is ensured, the hidden danger of aluminum leakage in the aluminum casting process of the rotor is completely eliminated, the success rate of aluminum casting of motor rotor is improved, and the quality of the cast-aluminum rotor is guaranteed. Moreover, it has the advantages of simple process and low cost.

The upper backing plate and the lower backing plate can be fastened to each other through the pull rod of the second pressing device, thus realizing the pressing of the upper and lower molds and the rotor core. There is no need to add complicated pressing equipment for pressing. Besides, the operation and adjustment are convenient and the operation efficiency is also improved.

BRIEF DESCRIPTION OF THE DRAWINGS

In order to explain the embodiments of the invention or the technical solutions in the prior art more clearly, the following will give a brief introduction to the drawings needed in the embodiments or the prior art description. It is obvious that the drawings in the following description are only some embodiments of the invention, and for those skilled in the art, they can also give other drawings based on the drawings without creative works. In the drawings.

DETAILED DESCRIPTION OF THE EMBODIMENTS

In order to make the object, technical solution and advantages of the invention clearer, the technical solution of the invention will be described completely in combination with the embodiments of the invention and the corresponding drawings. Obviously, the described embodiments are only part of the embodiments of the invention, not all of them. Based on the embodiments of the invention, all other embodiments obtained by those skilled in the art without creative works belong to the protection scope of the invention.

Figure 1:
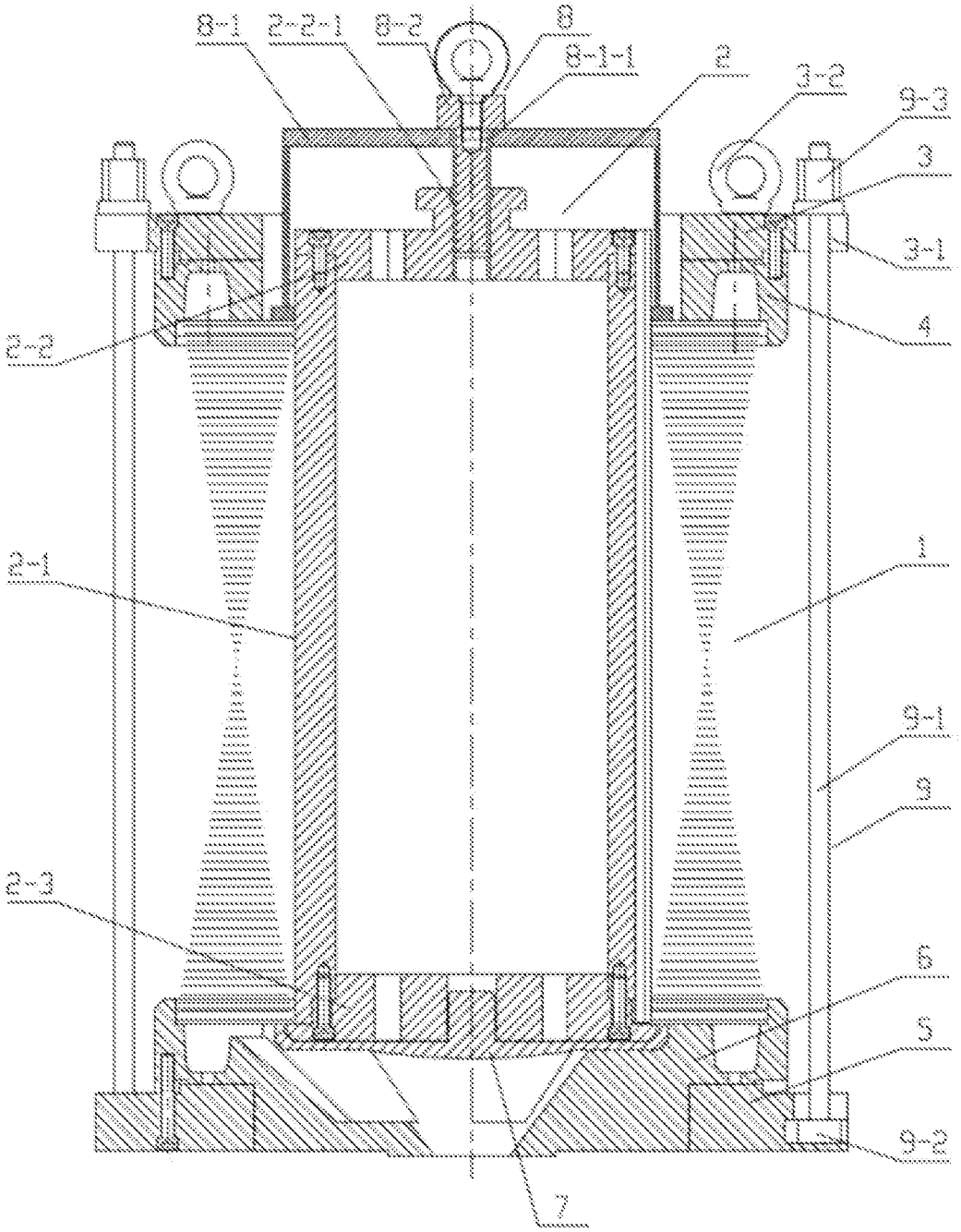
FIG. 1 is a structural diagram of the low-pressure cast aluminum mold for motor rotor of the present invention.
Figure 2:
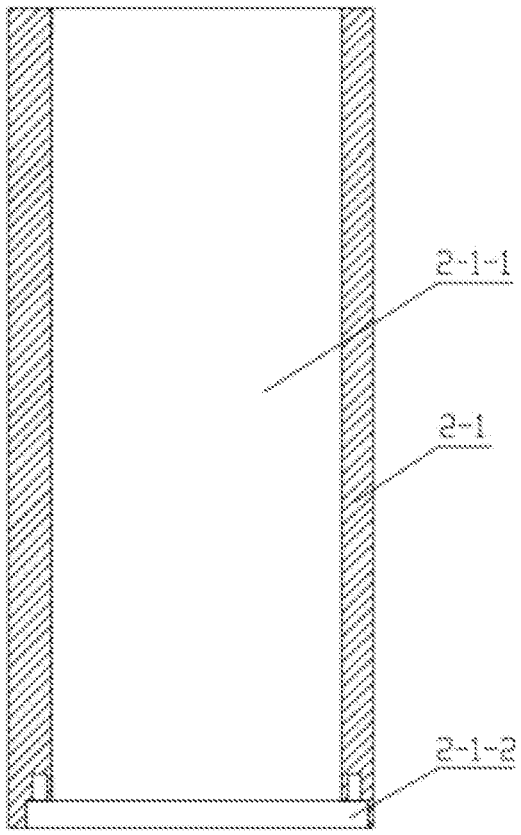
FIG. 2 is a structural diagram of the shaft body of the dummy shaft in the low-pressure aluminum casting mold for motor rotor of the present invention.
Figure 3:
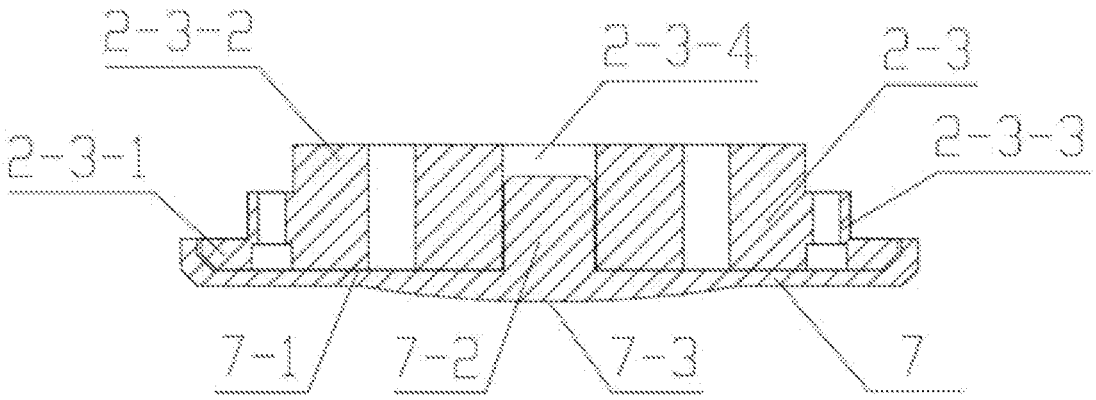
FIG. 3 is a structural diagram of the dummy shaft lower cover and the diverter in the low-pressure cast aluminum mold for motor rotor of the present invention.
Figure 4:
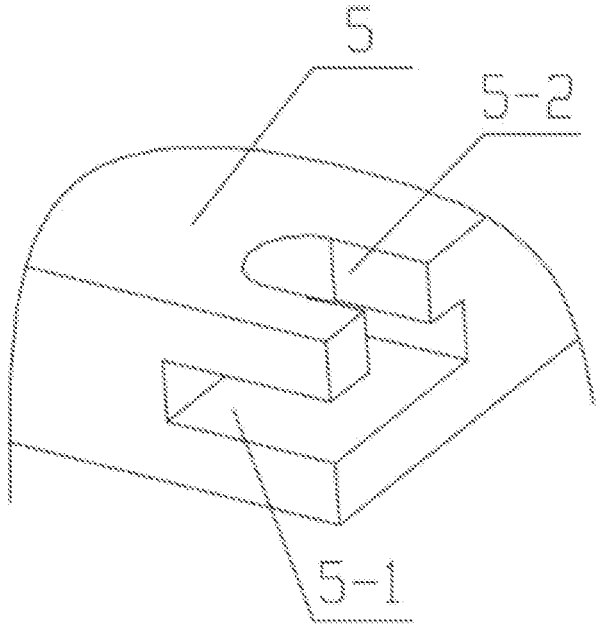
FIG. 4 is a partial structural diagram of the lower backing plate in the low-pressure cast aluminum mold for motor rotor of the present invention.

As shown in FIG. 1 to FIG. 4, the low-pressure aluminum casting mold for motor rotor of the present invention includes an upper blade profile assembly, a lower blade profile assembly, a rotor core 1, a dummy shaft 2 and a diverter 7. The upper blade profile assembly includes an upper backing plate 3 and an upper mold 4, and the lower blade profile assembly includes a lower backing plate 5 and a lower mold 6. The dummy shaft 2 includes a vertically arranged shaft body 2-1, a dummy shaft upper cover 2-2 arranged at the upper part of the shaft body 2-1, and a dummy shaft lower cover 2-3 arranged at the lower part of the shaft body 2-1. The diverter 7 is arranged between the dummy shaft 2 and the lower mold 6. The low-pressure aluminum casting mold further includes a first pressing device 8 and four sets of second pressing devices 9, wherein the first pressing device 8 is arranged at the top of the dummy shaft 2 to press the middle part of the rotor core 1, and the four sets of second pressing devices 9 are arranged at four corner positions of the low-pressure aluminum casting mold.

The middle parts of the four corners of the lower backing plate 5 are respectively provided with horizontal clamping slots 5-1 and U-shaped holes 5-2, the U-shaped hole 5-2 is provided on the lower backing plate 5 and above the clamping slot 5-1, the opening of the U-shaped hole 5-2 faces the outside, and the position of the upper backing plate 3 corresponding to the U-shaped hole 5-2 is provided with a hold-down through hole 3-1.

The second pressing device 9 includes a pull rod 9-1, a clamping plate 9-2 and a hold-down nut 9-3, wherein the clamping plate 9-2 is arranged in the clamping slot 5-1; the pull rod 9-1 is vertically arranged, and the bottom end of the pull rod 9-1 passes through the U-shaped hole 5-2 and is connected with the top surface of the clamping plate 9-2; the outer wall of the upper section of the pull rod 9-1 is provided with external threads; the top end of the pull rod 9-1 passes through the corresponding hold-down through hole 3-1; and the hold-down nut 9-3 is connected with the external threads on the pull rod 9-1 by threads.

The area of the horizontal cross section of the clamping slot 5-1 is larger than that of the U-shaped hole 5-2, thereby limiting the clamping plate 9-2 to prevent the clamping plate 9-2 from falling off in the fastening process.

The first pressing device 8 includes a pressing cover 8-1 and an eyebolt 8-2. The pressing cover 8-1 is a cylindrical tube structure with an open bottom and is coaxially covered on the top of the dummy shaft 2, and the bottom edge of the pressing cover 8-1 is pressed on the top surface of the rotor core 1. The middle part of the dummy shaft upper cover 2-2 is provided with a first threaded hole 2-2-1, the top surface of the pressing cover 8-1 is provided with a second threaded hole 8-1-1, and the lower end of the eyebolt 8-2 passes through the second threaded hole 8-1-1 and is connected with the first threaded hole 2-2-1. The first pressing device 8 presses the rotor core 1 with the pressing cover 8-1 by tightening the eyebolt 8-2.

The middle part of the shaft body 2-1 is vertically provided with a first through hole 2-1-1, the bottom end of the first through hole 2-1-1 is coaxially provided with an annular clamping slot 2-1-2, and the inner diameter of the annular clamping slot 2-1-2 is larger than that of the first through hole 2-1-1. The dummy shaft lower cover 2-3 includes a circular cover plate 2-3-1 and a cover body 2-3-2 arranged on the top surface of the circular cover plate 2-3-1, wherein the cover body 2-3-2 has a vertically arranged cylindrical structure, the upper part of the cover body 2-3-2 extends into the first through hole 2-1-1 and the bottom surface of the shaft body 2-1 is arranged on the top surface of the circular cover plate 2-3-1, the outer wall of the lower part of the cover body 2-3-2 is provided with an annular clamping table 2-3-3 matched with the annular clamping slot 2-1-2, the outer diameter of the circular cover plate 2-3-1 is larger than that of the shaft body 2-1, and the middle part of the dummy shaft lower cover 2-3 is vertically provided with a second through hole 2-3-4. The diverter 7 has a cylindrical structure, the middle of the top surface of the diverter 7 is provided with a cover plate placing groove 7-1 matched with the circular cover plate 2-3-1, the center of the cover plate placing groove 7-1 is coaxially provided with a cylindrical protrusion 7-2 which extends into the second through hole 2-3-4 and the circular cover plate 2-3-1 is placed in the cover plate placing groove 7-1, and the center of the bottom surface of the diverter 7 is provided with an arc protrusion 7-3 which bulges downward.

Furthermore, two sets of lifting rings 3-2 are arranged on the top surface of the upper backing plate 3 for the convenience of hoisting and transportation.

Furthermore, there is clearance fit between the cylindrical protrusion 7-2 and the second through hole 2-3-4, and between the cover plate placing groove 7-1 and the circular cover plate 2-3-1. The clearance fit between the diverter 7 and the dummy shaft lower cover 2-3 facilitates both installation and disassembly.

Furthermore, chamfers are arranged at the outer edge of the bottom surface of the circular cover plate 2-3-1, the outer edge of the bottom surface of the diverter 7, the bottom edge of the cover plate placing groove 7-1 and the bottom edge of the second through hole 2-3-4.

In the low-pressure aluminum casting mold for motor rotor of the present invention, the second pressing device 9 has simple structure, convenient operation and low cost, and can fasten the rotor core 1 through the hold-down nut 9-3 in the hot lamination process.

In the low-pressure aluminum casting mold for motor rotor of the present invention, the arrangement of the clamping slot 5-1 and the U-shaped hole 5-2 saves space, and can realize compaction without adding external compaction equipment, so that the cost is low and the lower mold 6 will not be affected.

In the low-pressure aluminum casting mold for motor rotor of the present invention, the arrangement of the circular arc protrusion 7-3 makes the distribution of molten aluminum more uniform, and improves the casting quality.

The low-pressure aluminum casting process for motor rotor of the present invention comprises the following steps:

1) cold lamination: sequentially stacking a plurality of rotor laminations on the dummy shaft 2 of the low-pressure aluminum casting mold, applying a lamination pressure to the pressing cover 8-1 of the first pressing device 8 by an oil press, thereby laminating the plurality of rotor laminations to form a rotor core 1. The tonnage of the oil press is 30-50 T and the lamination pressure exerted by the oil press is 2.5-3.0 MPa. After the whole height of the rotor core 1 reaches a first specified length, the rotor core 1 is fastened to the dummy shaft 2 by the pressing cover 8-1 and eyebolt 8-2 of the first pressing device 8;
2) heating of the rotor core: transporting the rotor core 1 fastened to the dummy shaft 2 by the first pressing device 8 in step 1) to a heating furnace for heating. Firstly, the rotor core 1 is heated at a temperature rise rate of 70-90° C./h for 1 hour and then kept warm for 1 hour. Then, the rotor core 1 is heated at a temperature rise rate of 70-90° C./h for 1 hour and then kept warm for 1 hour. Finally, the rotor core 1 is heated at a temperature rise rate of 80-100° C./h for 1 hour and then kept warm for 5 hours;
3) mold preparation: assembling the lower backing plate 5 and the lower mold 6, placing the diverter 7 on the lower mold 6, installing the clamping plate 9-2 in the clamping slot 5-1 of the lower backing plate 5, and vertically setting the pull rod 9-1 in place;
4) hot lamination: lifting the rotor core 1 heated in step 2) out of the heating furnace, placing the lower cover 2-3 of the dummy shaft 2 on the diverter 7, placing the upper backing plate 3 and the upper mold 4 on the rotor core 1, passing the hold-down through hole 3-1 on the upper backing plate 3 through the upper end of the pull rod 9-1, preliminarily fastening the rotor core 1 by a hold-down nut 9-3, and starting the oil press to continuously laminate the rotor core 1 until the overall height of the rotor core 1 reaches a second specified length, and then tightening the hold-down nut 9-3 again;
5) low-pressure casting: quickly lifting the whole mold fastened in step 4) to a low-pressure aluminum casting machine for aluminum casting, and completing the low-pressure aluminum casting of the motor rotor.

Due to the thermal expansion of the rotor core after being heated, in order to eliminate the influence of thermal expansion during hot lamination, the second specified length of the rotor core 1 in hot lamination is selected as 1.013 times of the first specified length of the rotor core 1 in cold lamination, i.e., the second specified length of the rotor core in hot lamination=the first specified length of the rotor core in cold lamination×1.013.

Further, in the low-pressure casting step, the pressure parameters of low-pressure aluminum casting are controlled as follows:

5.1) liquid lifting stage: pressurizing the molten aluminum at a pressure rise rate of 4.6-5.0 KPa/s for 10 s from an initial pressure of 2 KPa, thereby making the pressure reach 48-52 KPa;
5.2) mold filling stage: pressurizing at a pressure rise rate of 7.3-7.7 KPa/s for 4 s, thereby making the pressure reach 77.2-82.8 KPa;
5.3) pressure maintaining stage: maintaining the pressure at 77.2-82.8 KPa for 405 s;
5.4) pressure release stage: releasing the residual pressure after the pressure maintaining stage is completed.

The low-pressure aluminum casting process for motor rotor of the present invention will be described in detail with reference to the following specific embodiments.

Embodiment 1

The low-pressure aluminum casting process for motor rotor of Embodiment 1 includes the following steps:

1) cold lamination: sequentially stacking a plurality of rotor laminations on the dummy shaft 2 of the low-pressure aluminum casting mold, applying a lamination pressure to the pressing cover 8-1 of the first pressing device 8 by an oil press, thereby laminating the plurality of rotor laminations to form a rotor core 1. The tonnage of the oil press is 30 T and the lamination pressure exerted by the oil press is 2.5 MPa. After the whole height of the rotor core 1 reaches a first specified length, the rotor core 1 is fastened to the dummy shaft 2 by the pressing cover 8-1 and eyebolt 8-2 of the first pressing device 8;
2) heating of the rotor core: transporting the rotor core 1 fastened to the dummy shaft 2 by the first pressing device 8 in step 1) to a heating furnace for heating. Firstly, the rotor core 1 is heated at a temperature rise rate of 70° C./h for 1 hour and then kept warm for 1 hour. Then, the rotor core 1 is heated at a temperature rise rate of 70° C./h for 1 hour and then kept warm for 1 hour. Finally, the rotor core 1 is heated at a temperature rise rate of 80° C./h for 1 hour and then kept warm for 5 hours;
3) mold preparation: assembling the lower backing plate 5 and the lower mold 6, placing the diverter 7 on the lower mold 6, installing the clamping plate 9-2 in the clamping slot 5-1 of the lower backing plate 5, and vertically setting the pull rod 9-1 in place;
4) hot lamination: lifting the rotor core 1 heated in step 2) out of the heating furnace, placing the lower cover 2-3 of the dummy shaft 2 on the diverter 7, placing the upper backing plate 3 and the upper mold 4 on the rotor core 1, passing the hold-down through hole 3-1 on the upper backing plate 3 through the upper end of the pull rod 9-1, preliminarily fastening the rotor core 1 by a hold-down nut 9-3, and starting the oil press to continuously laminate the rotor core 1 until the overall height of the rotor core 1 reaches a second specified length, and then tightening the hold-down nut 9-3 again, wherein the second specified length of the rotor core 1 in hot lamination=the first specified length of the rotor core 1 in cold lamination×1.013;
5) low-pressure casting: quickly lifting the whole mold fastened in step 4) to a low-pressure aluminum casting machine for aluminum casting, and completing the low-pressure aluminum casting of the motor rotor.

Embodiment 2

The low-pressure aluminum casting process for motor rotor of Embodiment 2 includes the following steps:

1) cold lamination: sequentially stacking a plurality of rotor laminations on the dummy shaft 2 of the low-pressure aluminum casting mold, applying a lamination pressure to the pressing cover 8-1 of the first pressing device 8 by an oil press, thereby laminating the plurality of rotor laminations to form a rotor core 1. The tonnage of the oil press is 40 T and the lamination pressure exerted by the oil press is 2.8 MPa. After the whole height of the rotor core 1 reaches a first specified length, the rotor core 1 is fastened to the dummy shaft 2 by the pressing cover 8-1 and eyebolt 8-2 of the first pressing device 8;

2) heating of the rotor core: transporting the rotor core 1 fastened to the dummy shaft 2 by the first pressing device 8 in step 1) to a heating furnace for heating. Firstly, the rotor core 1 is heated at a temperature rise rate of 80° C./h for 1 hour and then kept warm for 1 hour. Then, the rotor core 1 is heated at a temperature rise rate of 80° C./h for 1 hour and then kept warm for 1 hour. Finally, the rotor core 1 is heated at a temperature rise rate of 90° C./h for 1 hour and then kept warm for 5 hours;

3) mold preparation: assembling the lower backing plate 5 and the lower mold 6, placing the diverter 7 on the lower mold 6, installing the clamping plate 9-2 in the clamping slot 5-1 of the lower backing plate 5, and vertically setting the pull rod 9-1 in place;

4) hot lamination: lifting the rotor core 1 heated in step 2) out of the heating furnace, placing the lower cover 2-3 of the dummy shaft 2 on the diverter 7, placing the upper backing plate 3 and the upper mold 4 on the rotor core 1, passing the hold-down through hole 3-1 on the upper backing plate 3 through the upper end of the pull rod 9-1, preliminarily fastening the rotor core 1 by a hold-down nut 9-3, and starting the oil press to continuously laminate the rotor core 1 until the overall height of the rotor core 1 reaches a second specified length, and then tightening the hold-down nut 9-3 again, wherein the second specified length of the rotor core 1 in hot lamination=the first specified length of the rotor core 1 in cold lamination×1.013;

5) low-pressure casting: quickly lifting the whole mold fastened in step 4) to a low-pressure aluminum casting machine for aluminum casting, and completing the low-pressure aluminum casting of the motor rotor.

Embodiment 3

The low-pressure aluminum casting process for motor rotor of Embodiment 3 includes the following steps:

1) cold lamination: sequentially stacking a plurality of rotor laminations on the dummy shaft 2 of the low-pressure aluminum casting mold, applying a lamination pressure to the pressing cover 8-1 of the first pressing device 8 by an oil press, thereby laminating the plurality of rotor laminations to form a rotor core 1. The tonnage of the oil press is 50 T and the lamination pressure exerted by the oil press is 3.0 MPa. After the whole height of the rotor core 1 reaches a first specified length, the rotor core 1 is fastened to the dummy shaft 2 by the pressing cover 8-1 and eyebolt 8-2 of the first pressing device 8;

2) heating of the rotor core: transporting the rotor core 1 fastened to the dummy shaft 2 by the first pressing device 8 in step 1) to a heating furnace for heating. Firstly, the rotor core 1 is heated at a temperature rise rate of 90° C./h for 1 hour and then kept warm for 1 hour. Then, the rotor core 1 is heated at a temperature rise rate of 90° C./h for 1 hour and then kept warm for 1 hour. Finally, the rotor core 1 is heated at a temperature rise rate of 100° C./h for 1 hour and then kept warm for 5 hours;

3) mold preparation: assembling the lower backing plate 5 and the lower mold 6, placing the diverter 7 on the lower mold 6, installing the clamping plate 9-2 in the clamping slot 5-1 of the lower backing plate 5, and vertically setting the pull rod 9-1 in place;

4) hot lamination: lifting the rotor core 1 heated in step 2) out of the heating furnace, placing the lower cover 2-3 of the dummy shaft 2 on the diverter 7, placing the upper backing plate 3 and the upper mold 4 on the rotor core 1, passing the hold-down through hole 3-1 on the upper backing plate 3 through the upper end of the pull rod 9-1, preliminarily fastening the rotor core 1 by a hold-down nut 9-3, and starting the oil press to continuously laminate the rotor core 1 until the overall height of the rotor core 1 reaches a second specified length, and then tightening the hold-down nut 9-3 again, wherein the second specified length of the rotor core 1 in hot lamination=the first specified length of the rotor core 1 in cold lamination×1.013;

5) low-pressure casting: quickly lifting the whole mold fastened in step 4) to a low-pressure aluminum casting machine for aluminum casting, and completing the low-pressure aluminum casting of the motor rotor.

To sum up, compared with the prior art, the low-pressure aluminum casting mold for motor rotor and the low-pressure aluminum casting process for motor rotor have the following advantages and beneficial effects.

In the low-pressure aluminum casting mold for motor rotor, the compression of the first pressing device and the second pressing device ensures the lamination compactness of the rotor core, thoroughly eliminates the hidden danger of aluminum leakage in the aluminum casting process of the rotor, improves the success rate of aluminum casting of the motor rotor, ensures the quality of the cast-aluminum rotor, and has the advantages of simple process and low cost. The second pressing device fastens the upper backing plate and the lower backing plate through the pull rod, which realizes the pressing of the upper and lower molds and the rotor core. It has simple structure and there is no need to add complicated pressing equipment for compression. The operation and adjustment are convenient and the operation efficiency is also improved. The downward-bulged arc protrusion arranged at the center of the bottom surface of the diverter makes the distribution of molten aluminum more uniform and thus improves the casting quality.

In the low-pressure aluminum casting process for motor rotor, through the cold lamination and hot lamination together with the double compression of the first pressing device and the second pressing device, the lamination compactness of the rotor core is ensured, the hidden danger of aluminum leakage in the aluminum casting process of the rotor is completely eliminated, the success rate of aluminum casting of motor rotor is improved, and the quality of the cast-aluminum rotor is guaranteed. Moreover, it has the advantages of simple process and low cost. The upper backing plate and the lower backing plate can be fastened to each other through the pull rod of the second pressing device, thus realizing the pressing of the upper and lower molds and the rotor core. There is no need to add complicated pressing equipment for pressing. Besides, the operation and adjustment are convenient and the operation efficiency is also improved.

It should be noted that in the context of this invention, the terms such as "first" and "second" are only used to distinguish one component or operation from another, and do not necessarily require or imply any such actual relationship or order between these components or operations. Moreover, the terms "include", "comprise" or any other variation thereof are intended to cover non-exclusive inclusion, so that a process, method, article or device including a series of elements includes not only those elements, but also other elements not explicitly listed, or elements inherent in such process, method, article or device. In addition, unless otherwise specified, "front", "back", "left", "right", "up", "down", "inside" and "outside" in the context of this invention are all referred to the placement state shown in the figures.

It is to be understood that the foregoing description relates to exemplary embodiments of the present invention and that modifications may be made without departing from the spirit and scope of the present invention as set forth in the claims.

What is claimed is:

1. A low-pressure aluminum casting process for a motor rotor, the process including the following steps:

a) cold lamination: sequentially stacking a plurality of rotor laminations on a dummy shaft (2) of a low-pressure aluminum casting mold, applying a lamination pressure to a pressing cover (8-1) of a first pressing device (8) by an oil press, thereby laminating the plurality of rotor laminations to form a rotor core (1), wherein tonnage of the oil press is 30-50 T and the lamination pressure exerted by the oil press is 2.5-3.0 MPa; after a whole height of the rotor core (1) reaches a first specified length, the rotor core (1) is fastened to the dummy shaft (2) by the pressing cover (8-1) and an eyebolt (8-2) of the first pressing device (8);

b) heating of the rotor core: transporting the rotor core (1) fastened to the dummy shaft (2) by the first pressing device (8) in step a) to a heating furnace for heating, wherein, firstly the rotor core (1) is heated at a temperature rise rate of 70-90° C./h for 1 hour and then kept warm for 1 hour, then the rotor core (1) is heated at a temperature rise rate of 70-90° C./h for 1 hour and then kept warm for 1 hour, finally the rotor core (1) is heated at a temperature rise rate of 80-100° C./h for 1 hour and then kept warm for 5 hours;

c) mold preparation: assembling a lower backing plate (5) and a lower mold (6), placing a diverter (7) on the lower mold (6), installing a clamping plate (9-2) in a clamping slot (5-1) of the lower backing plate (5), and vertically setting a pull rod (9-1) in place;

d) hot lamination: lifting the rotor core (1) heated in step b) out of the heating furnace, placing a lower cover (2-3) of the dummy shaft (2) on the diverter (7), placing an upper backing plate (3) and an upper mold (4) on the rotor core (1), passing a hold-down through hole (3-1) on the upper backing plate (3) through an upper end of the pull rod (9-1), preliminarily fastening the rotor core (1) by a hold-down nut (9-3), and starting the oil press to continuously laminate the rotor core (1) until an overall height of the rotor core (1) reaches a second specified length, and then tightening the hold-down nut (9-3) again; and e) low-pressure casting: lifting a whole mold fastened in step d) to a low-pressure aluminum casting machine for aluminum casting, and completing low-pressure aluminum casting of the motor rotor.

2. The low-pressure aluminum casting process for a motor rotor according to claim 1, wherein the second specified length of the rotor core in hot lamination is 1.013 times of the first specified length of the rotor core in cold lamination.

3. The low-pressure aluminum casting process for motor rotor according to claim 1, wherein, in the step of low-pressure casting, pressure parameters of low-pressure aluminum casting are controlled as follows:

liquid lifting stage: pressurizing molten aluminum at a pressure rise rate of 4.6-5.0 KPa/s for 10 s from an initial pressure of 2 KPa, thereby making the pressure reach 48-52 KPa;

mold filling stage: pressurizing at a pressure rise rate of 7.3-7.7 KPa/s for 4 s, thereby making the pressure reach 77.2-82.8 KPa;

pressure maintaining stage: maintaining the pressure at 77.2-82.8 KPa for 405 s;

pressure release stage: releasing residual pressure after the pressure maintaining stage is completed.

* * * * *